US009145722B2

(12) United States Patent
Gherardi

(10) Patent No.: US 9,145,722 B2
(45) Date of Patent: Sep. 29, 2015

(54) BALANCED HINGE DEVICE WITH PROGRAMMABLE BRAKE

(71) Applicant: C.M.I. Cerniere Meccaniche Industriali S.r.l., Crespellano (IT)

(72) Inventor: Eros Gherardi, Bologna (IT)

(73) Assignee: C.M.I. Cerniere Meccaniche Industriali S.R.L., Crespellano (Bologna) (IT)

( * ) Notice: Subject to any disclaimer, the term of this patent is extended or adjusted under 35 U.S.C. 154(b) by 0 days.

(21) Appl. No.: 14/400,191

(22) PCT Filed: May 15, 2013

(86) PCT No.: PCT/EP2013/060034

§ 371 (c)(1),
(2) Date: Nov. 10, 2014

(87) PCT Pub. No.: WO2013/171261

PCT Pub. Date: Nov. 21, 2013

(65) Prior Publication Data

US 2015/0096148 A1 Apr. 9, 2015

(30) Foreign Application Priority Data

May 17, 2012 (IT) ..... BO2012A0273

(51) Int. Cl.
*E05F 1/08* (2006.01)
*E05D 11/00* (2006.01)
(Continued)

(52) U.S. Cl.
CPC ..... *E05D 11/00* (2013.01); *E05D 11/08* (2013.01); *E05F 1/1261* (2013.01);
(Continued)

(58) Field of Classification Search
CPC ..... F16F 15/03; F16F 6/00; F16F 6/005; F24C 15/02; F24C 15/023; E05F 1/1276; E05F 1/1292; E05F 1/1261; E05F 1/1253; E05Y 2201/41; E05Y 2201/412; E05Y 2201/414; E05Y 2201/416; E05Y 2201/40; E05Y 2201/46; E05Y 2900/308; E05D 11/1064; Y10T 16/5383
USPC ..... 16/286, 289, 290, 292, 321, 320, 322, 16/306; 49/386, 387, 389, 398, 402; 126/190, 191, 192, 285 R, 287, 289; 312/323, 325, 326
See application file for complete search history.

(56) References Cited

U.S. PATENT DOCUMENTS 7,017,232 B1 * 3/2006 Priddy ..... 16/286
2003/0172920 A1 * 9/2003 Gronbach ..... 126/197
(Continued)

FOREIGN PATENT DOCUMENTS

EP 1764557 A2 * 3/2007

OTHER PUBLICATIONS

International Search Report for PCT/EP2013/060034, dated Aug. 20, 2013, 8 pages.

*Primary Examiner* — Chuck Mah
(74) *Attorney, Agent, or Firm* — Francis J. Maguire; Ware Fressola Maguire & Barber LLP

(57) ABSTRACT

A balanced hinge device with a programmable brake for household appliances has first and second connection members (4, 5) mutually pivoted through a first pivot pin (6) and interconnected by a kinematic device (11) having an arm (8), pivoted via a second pivot pin (9) to one of the two members (4, 5). The arm (8) and one of the two members (4, 5) has a through slot (2) and the other member has a friction element (3) slidably frictionally engaged with the through slot (2) which is approximately shaped to follow a trajectory of the friction element (3) between a full closed condition (C) and a full open condition (A).

9 Claims, 9 Drawing Sheets

(51) Int. Cl.

| | |
|---|---|
| ***E05D 11/08*** | (2006.01) |
| ***E05F 1/12*** | (2006.01) |
| ***F24C 15/02*** | (2006.01) |
| *A47L 15/42* | (2006.01) |

(52) U.S. Cl.

CPC ..... *F24C 15/023* (2013.01); *A47L 15/4261* (2013.01); *E05Y 2201/21* (2013.01); *E05Y 2201/26* (2013.01); *E05Y 2800/266* (2013.01); *E05Y 2900/304* (2013.01); *E05Y 2900/308* (2013.01)

(56) References Cited

U.S. PATENT DOCUMENTS

| | | | | |
|---|---|---|---|---|
| 2003/0213098 | A1* | 11/2003 | Cummins et al. | 16/286 |
| 2007/0101542 | A1* | 5/2007 | Lee | 16/286 |
| 2007/0209654 | A1* | 9/2007 | Wang | 126/194 |
| 2010/0229345 | A1* | 9/2010 | Donoho | 16/374 |
| 2011/0017191 | A1* | 1/2011 | White et al. | 126/198 |
| 2013/0291853 | A1* | 11/2013 | Braden et al. | 126/19 R |

* cited by examiner

FIG.5
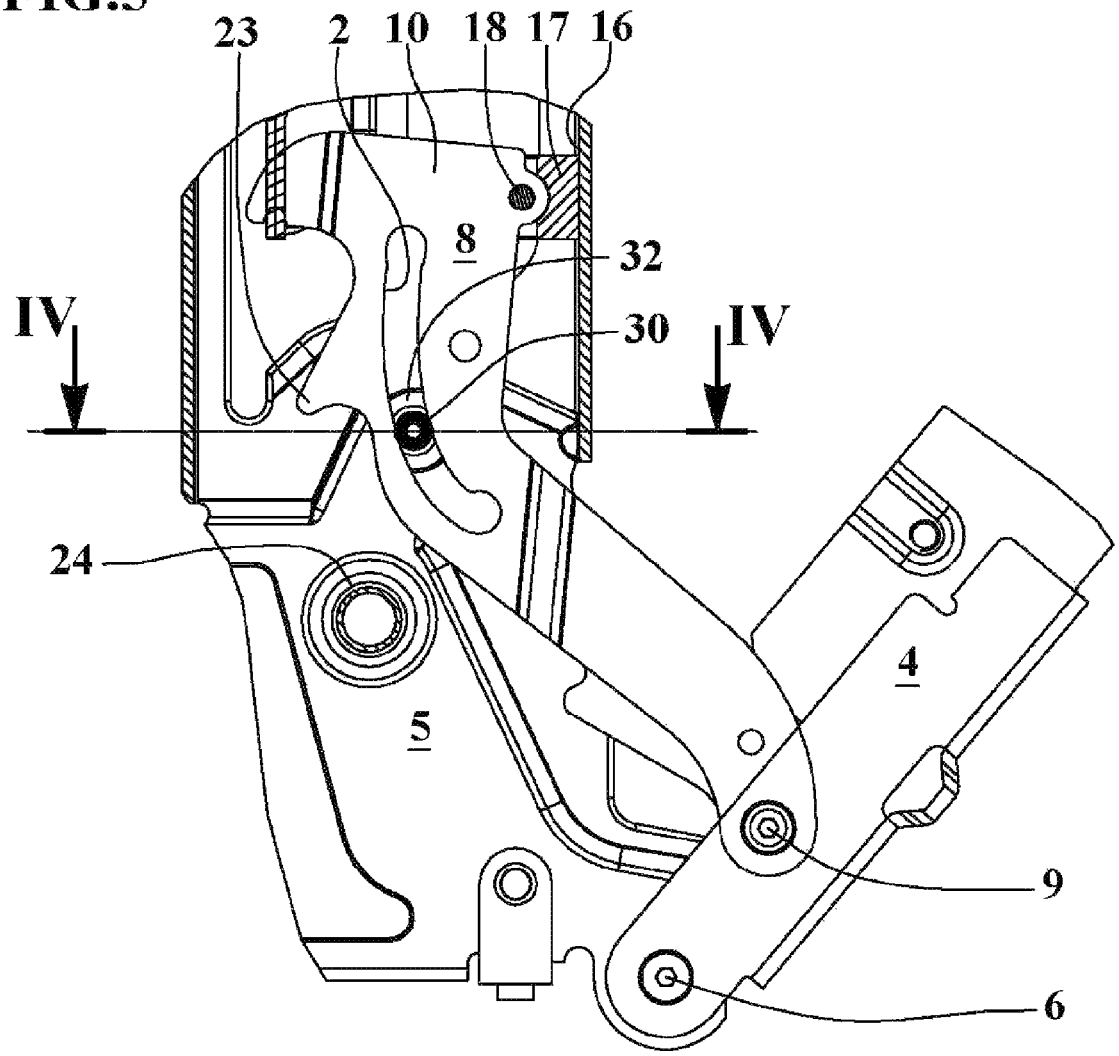
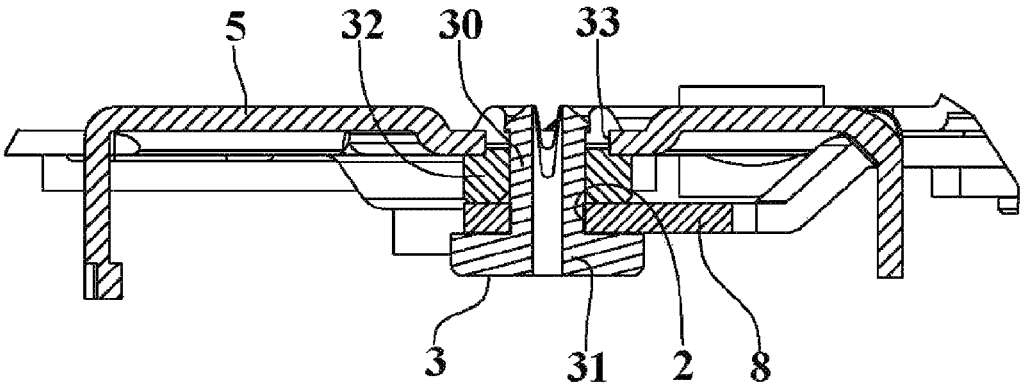
FIG.4

BALANCED HINGE DEVICE WITH PROGRAMMABLE BRAKE

CROSS REFERENCE TO RELATED APPLICATIONS

This application is a national Stage of PCT/EP2013/060034, filed 15 May 2013, which claimed priority in Italian patent application no. B02012A 000273, filed 17 May 2014, the contents of these applications incorporated herein by reference.

TECHNICAL FIELD

The present invention relates to the field concerning hinges and refers to a balanced hinge device with a programmable brake particularly suitable for appliances doors having openings with a lower horizontal axis.

BACKGROUND ART

There are known several hinge devices equipped with springs to balance door weight and with a brake assigned to moderate the opening and closing speed.

U.S. Published Patent Application no. 2007/101542 A1 discloses a balanced hinge device with selective motion arrest for an electric household appliance.

One disadvantage of these known devices consists in that they typically provide a constant frictional braking element not easily controllable and/or programmable.

Another disadvantage of the known devices consists in that they are generally very complex and expensive.

SUMMARY OF THE INVENTION

One purpose of the present invention is to propose a device which provides a braking effect as a function of the opening angle according to a law determined in any stage of production according to the contingent needs.

Another purpose is to propose a device able to provide an additional braking effect, almost constant.

A further object is to propose a device which is reliable, durable and relatively simple and inexpensive.

BRIEF DESCRIPTION OF THE DRAWINGS

The characteristics of the invention are highlighted in the following with particular reference to the accompanying drawings wherein:

FIG. 4 shows a partial and enlarged view of the device of FIG. 3 in a further partial open condition;

FIG. 5 shows a sectional view along the plane V-V of FIG. 4;

DETAILED DESCRIPTION OF THE INVENTION

Figure 1:
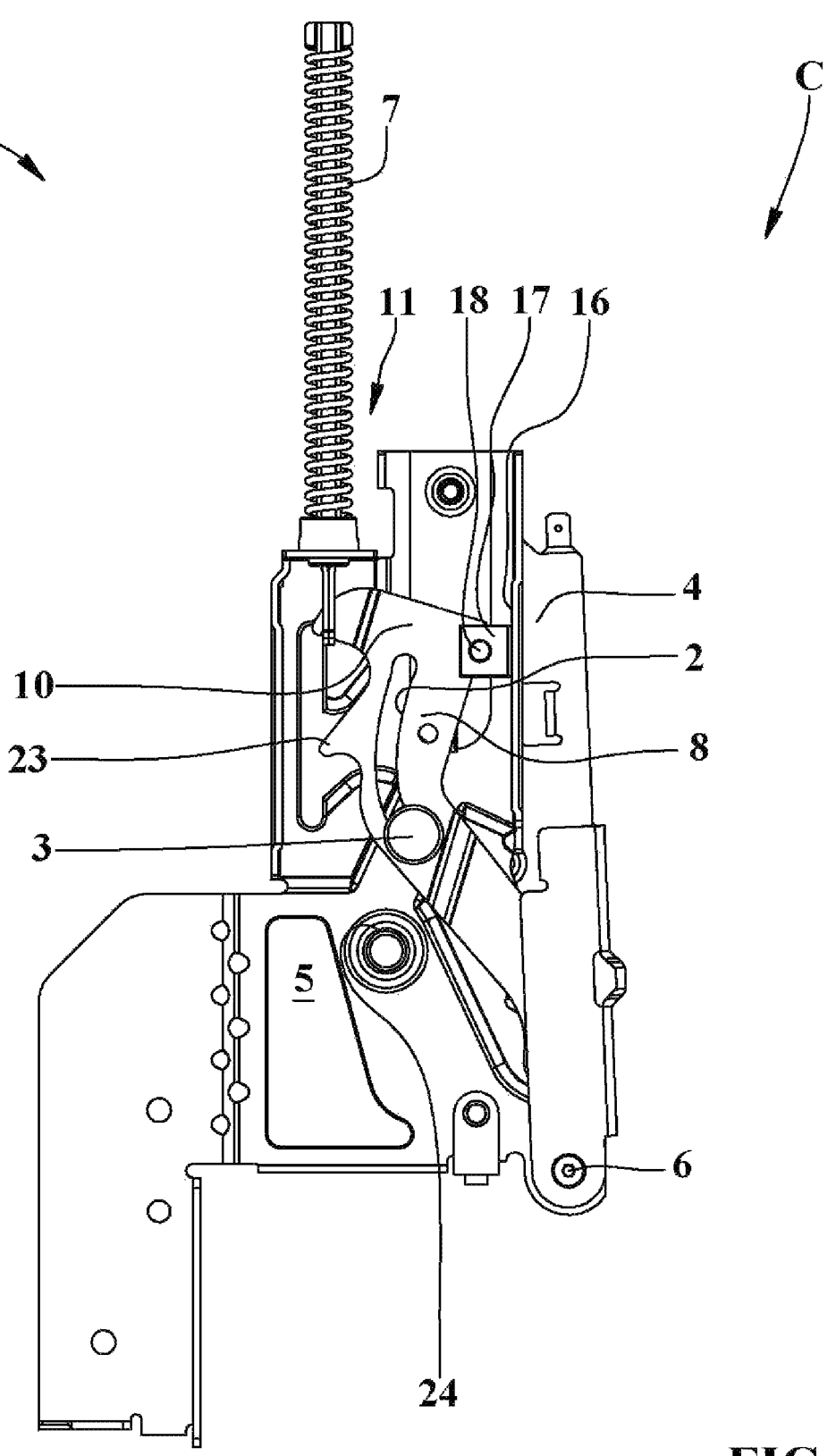
FIG. 1 shows a side view of the balanced hinge device with a programmable brake, the object of the present invention, in a full close condition.
Figure 2:
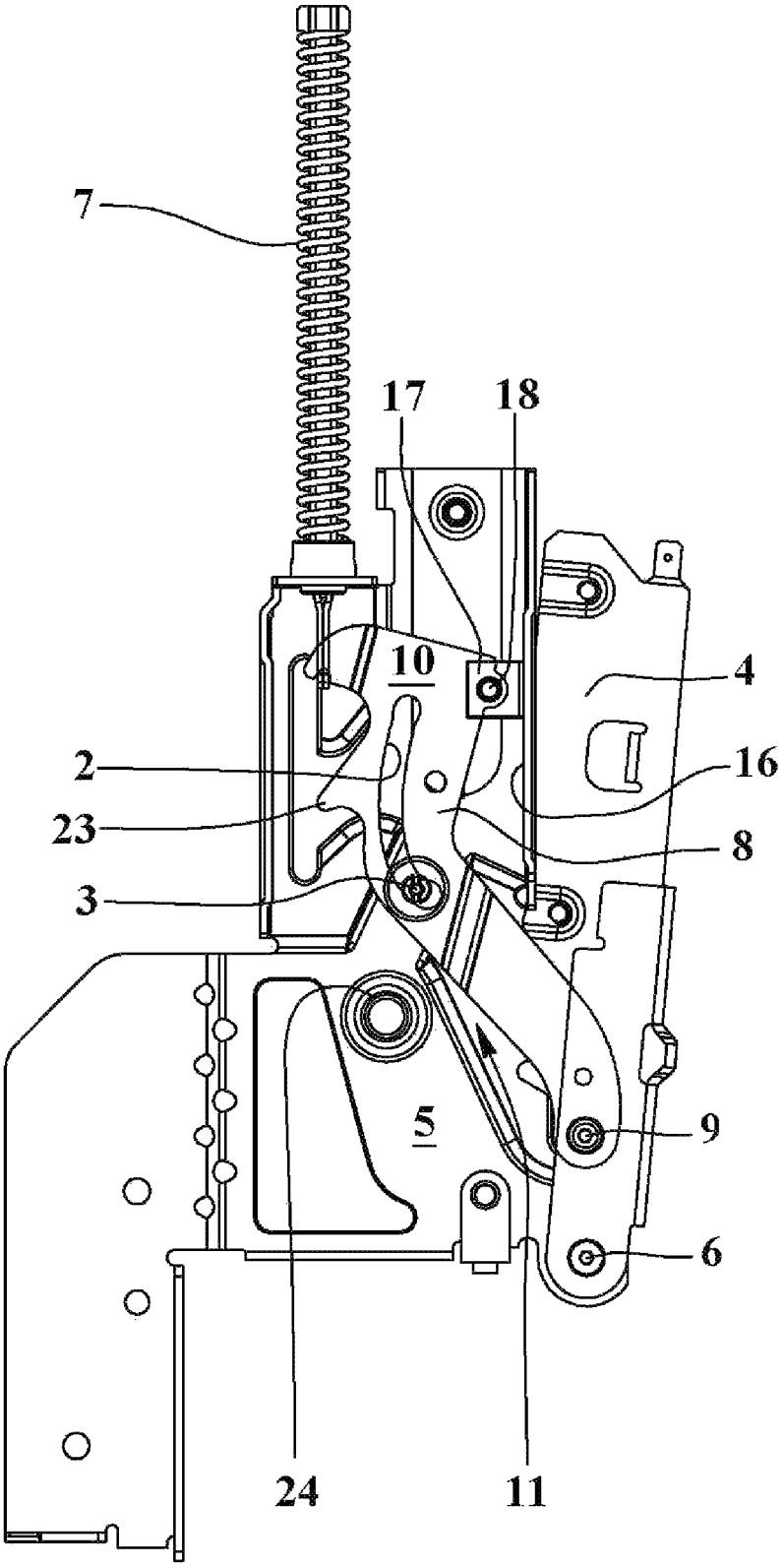
FIGS. 2 and 3 show views of the device of FIG. 1 in progressive and partial opening condition wherein some elements are shown in transparency.
Figure 3:
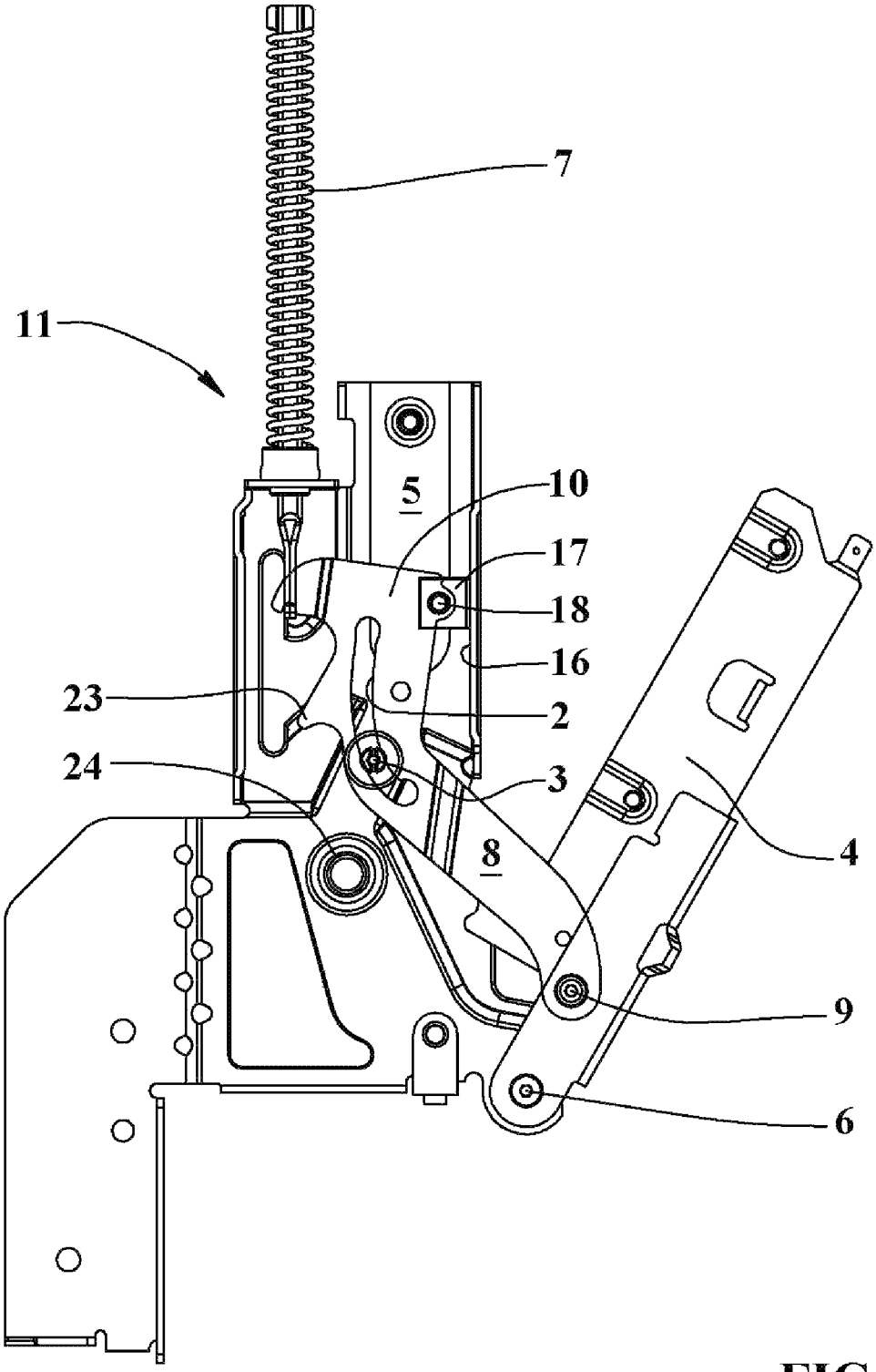
Figure 6:
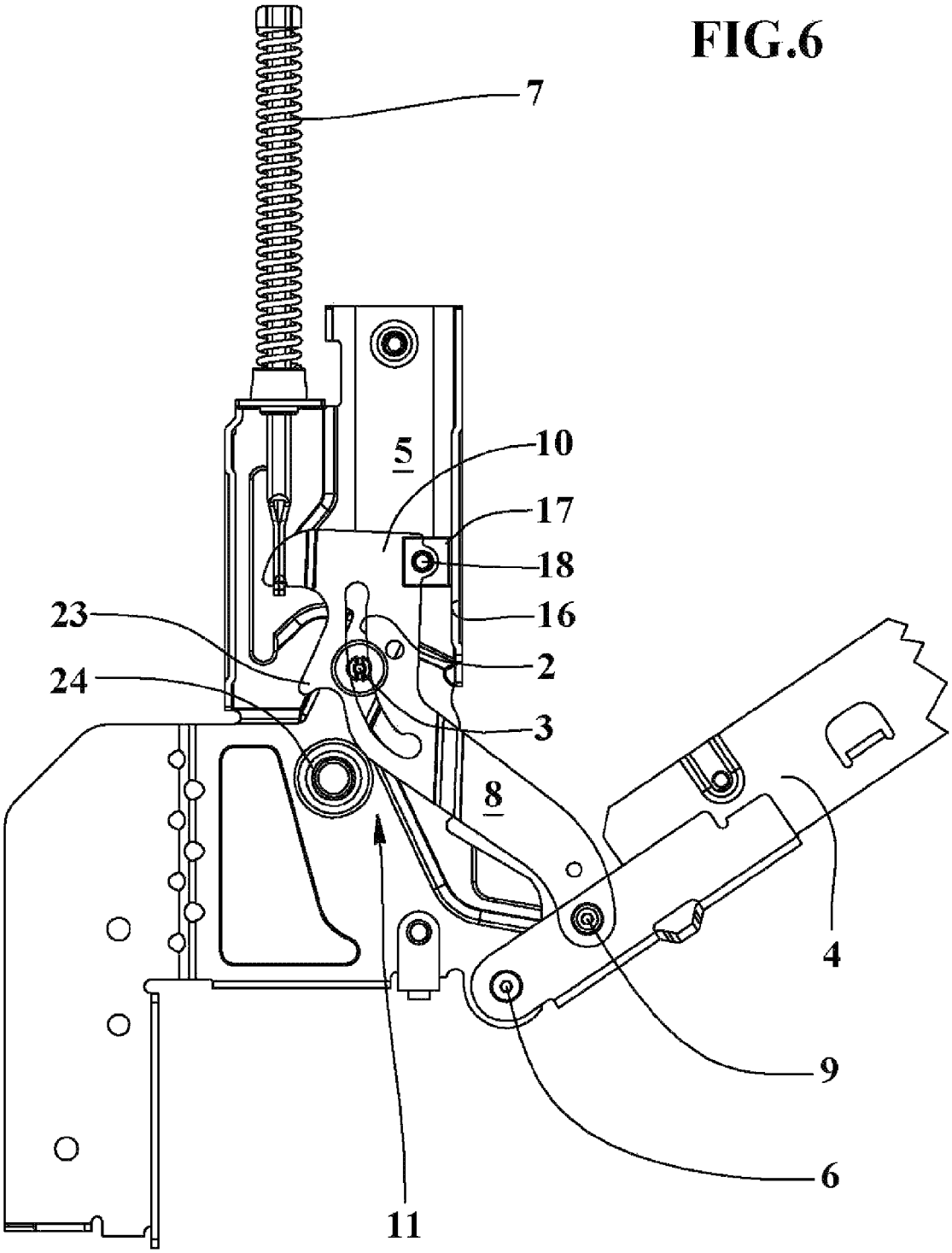
FIGS. 6 to 8 show views of the device of FIG. 1 in further opening steps up to the full open condition of FIG. 8.
Figure 7:
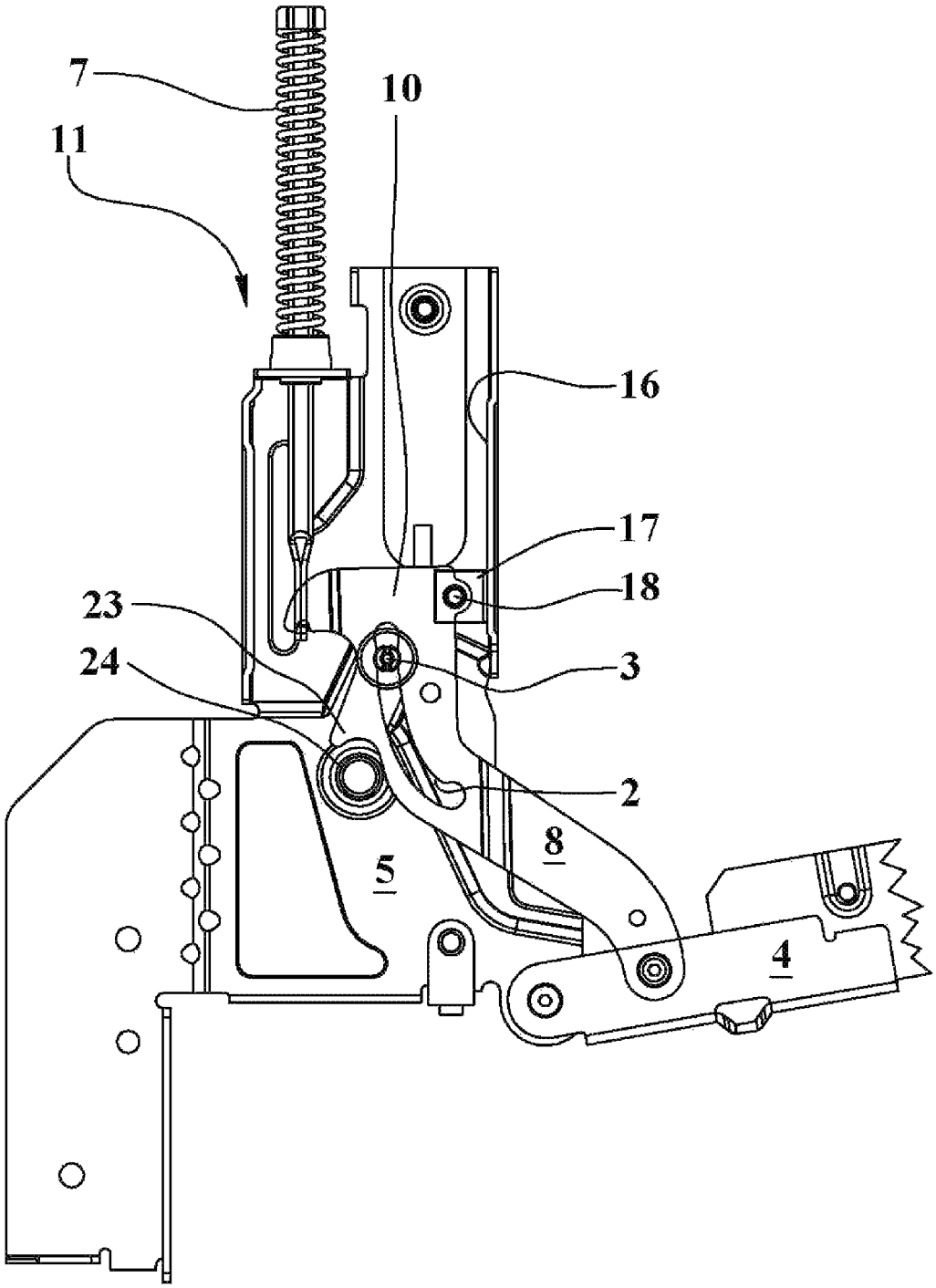
Figures 8, 9:
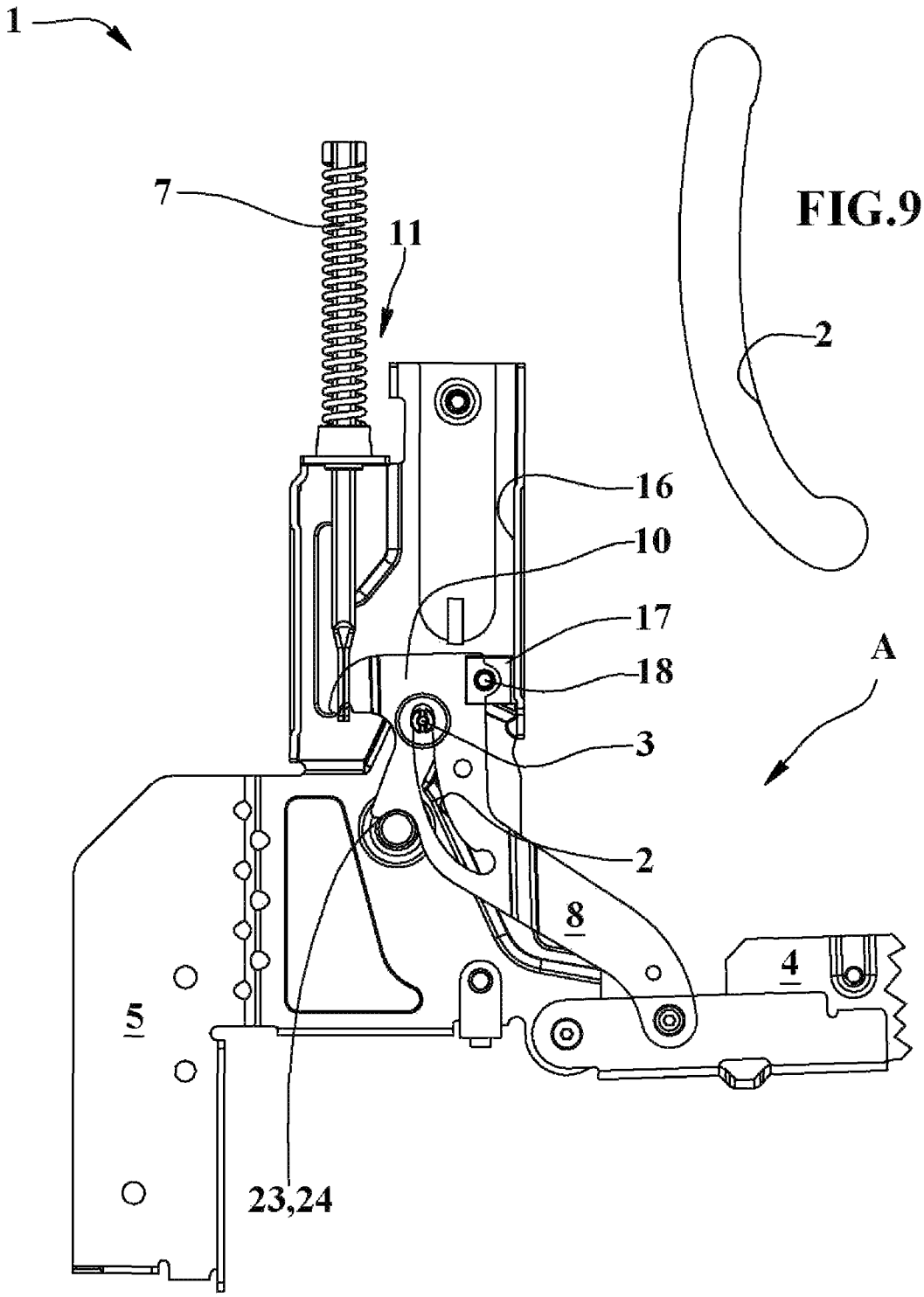
FIG. 9 shows a plan and enlarged view of the profile of a through slot of FIG. 1.
Figure 10:
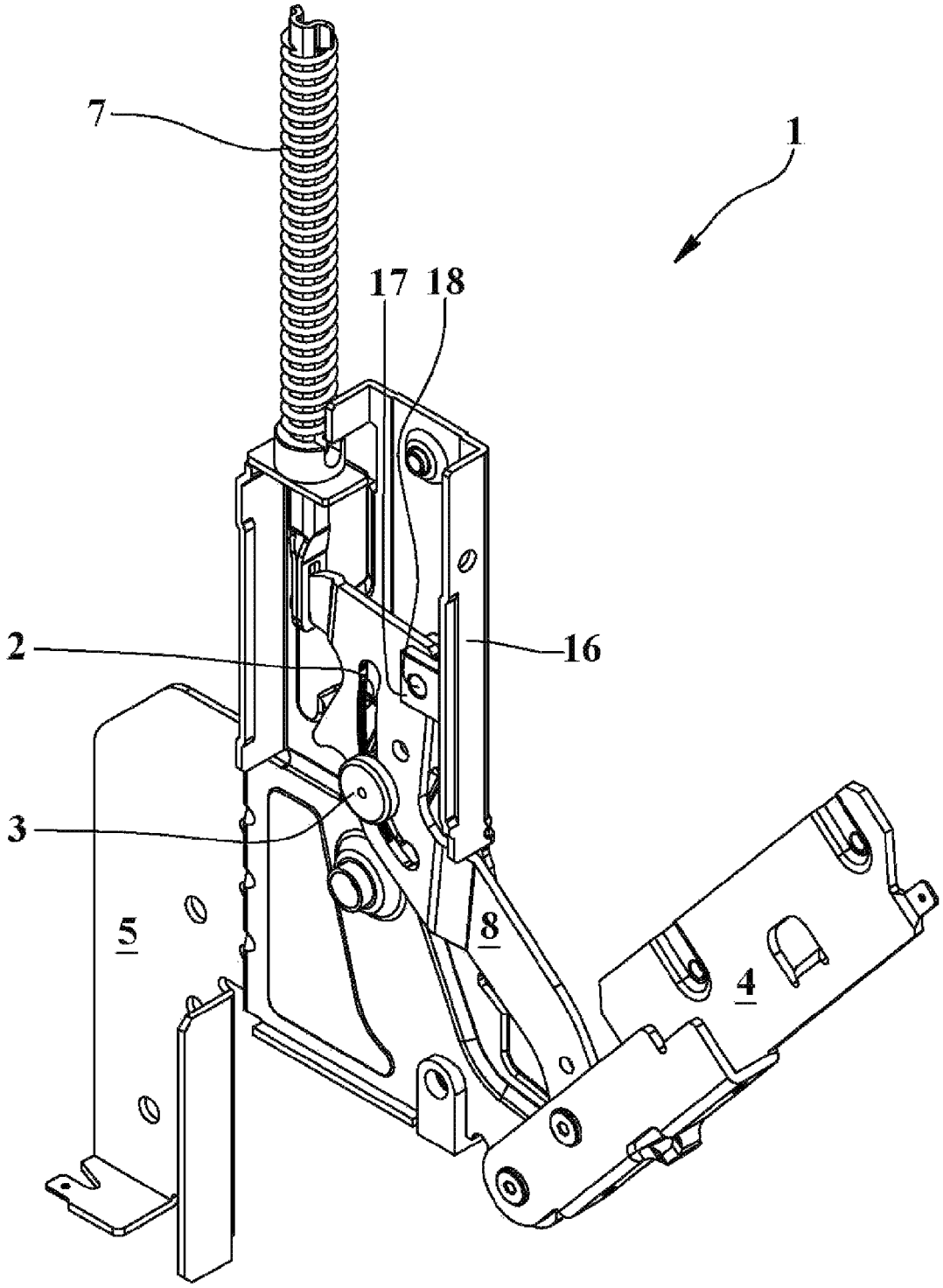
FIG. 10 shows an axonometric view of the device of FIG. 1 in a partial open condition.
Figure 11:
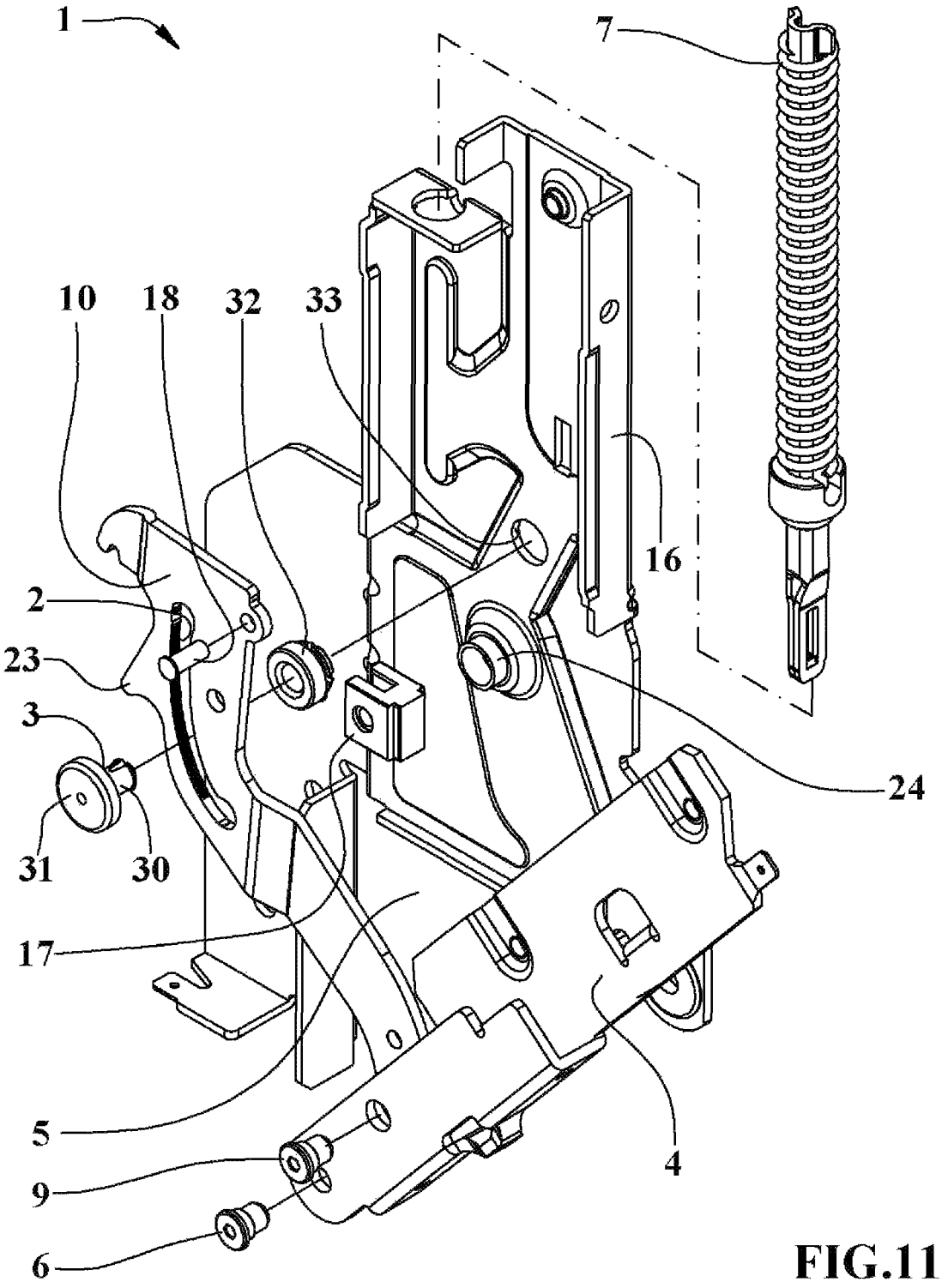
FIG. 11 shows an exploded and axonometric view of the device of FIG. 1.

With reference to FIGS. 1 to 11, numeral 1 indicates the balanced hinge device with a programmable brake which is the object of the present invention, for appliances and furniture in general.

The device 1 is provided with a first connecting member 4 and a second connecting member 5 adapted to be fixed respectively to a door and to a structure or frame of the appliance or furniture for the rotation of the door between the full close condition C and full open condition A.

Those first and second connecting members 4, 5 are mutually pivoted through a first pivot pin 6 and are interconnected by kinematic means 11 having an arm 8 pivoted via a second pivot pin 9 to the first connecting member 4. The kinematic means 11 also has elastic means 7 consisting, for example, of a helical spring working in compression having a fixed end in abutment with a cup or the like of the second connection member. The remaining end of the spring is connected, via a spring guide located inside the spring itself, to the end 10 of the arm 8 opposite to the second pivot pin 9 to provide to the first and second connecting members 4, 5, an elastic closing force. In this way the arm 8 acts as a pull rod and transmits to the first connecting member 4, the elastic force of the spring of the elastic means 7 which acts on that first connecting member 4 in the direction according to the closing and approaching movement to the second connecting member 5.

The first and second connecting members 4, 5 and the arm 8 are preferably made of cut and bent sheet metal. The thickness of the arm 8 can be equal or greater than the thickness of the connecting members.

The arm 8 has a shaped through slot 2 and the second connecting member 5 bears a friction means 3 slidably engaged with friction in the through slot 2. Alternatively the invention provides that the friction means 3 can be fixed to the arm 8 and that the through slot 2 is carried out in the second connecting member 5. A further alternative provides that the through slot 2 can be carried out in the first connecting member 4 and that the friction means 3 can be fixed to the second connecting member 5, or vice versa, in such an alternative the arm 8 becomes optional.

The through slot 2 is approximately shaped according to the followed trajectory taken by friction means 3 between the full close condition C and the full open condition A viewed from the arm 8, so that in the transition from the full close to the full open condition and vice versa, the friction means 3 runs through the through slot 2 and the arm 8 is free to move without being locked by interference between the friction means 3 and the through slot 2.

The friction means 3 include a rod 30 engaged to the through slot 2 and having one end fixed to the respective arm or connecting member and the other end bearing an enlarged head 31 assigned to prevent the rod 30 from disengagement from the through slot 2.

The end of the rod 30 opposite to the enlarged head 31 has respective interlocking means to fix to a bushing 32 fixed in a seat 33 carried out in the respective arm or connecting member.

The friction means 3 and the bushing 32 can be made of plastic, resin or the like or can be made of metal and the rod and optionally portions of the head and of the bushing in contact with the arm can be made of a sleeve and of washers of a synthetic material, plastic and the like.

The rod 30, or its bushing, is made of an at least partially elastic material.

The width or the transverse dimension of the through slot 2 varies from a value approximately equal to or slightly greater than the transverse dimension of the not deformed rod 30 to a value smaller than said not deformed diameter.

The transverse dimension of the through slot 2 is modulated to predetermine the friction between the through slot 2 and the friction mean at the various opening angles of the first and the second connection members 4, 5.

For example, an initial and/or end portion of the through slot 2, corresponding to the closing and opening conditions, may have a width greater than the transverse dimension of the rod to avoid friction in such conditions. The very short portion immediately following the initial and/or end portion can have a narrowing that allows the passage of the rod with some effort and with one click. The remaining parts of the through slot 2 can have widths decreasing toward the open condition for a progressive slowing down towards the open condition in which the door is almost horizontal and placed below.

The inner edges of the through slot 2, assigned to abut the rod or its optional bushing, are milled, grooved or otherwise worked to increase friction and the rod 30 of the friction means 3 is cylindrical or, alternatively, can be shaped as a soap bar or similar for example to increase the contact surface of the rod with the walls of the through slot 2. The width of the walls for the through slot 2 corresponds to the thickness of the arm 8 which can be made of sheet or plate metal having a thickness greater than the remaining parts of the device.

The surfaces of the enlarged head 31 and of the bushing 32 facing each other are flat and the length of the rod portion 30 between them is approximately equal to or slightly smaller than the thickness of the arm 8 so that these flat surfaces abut the opposite faces of the arm 8 creating an additional almost constant friction between the entities and independent on the opening angle.

The second connecting member 5 bears a first sliding guide 16, for example consisting of a folded edge at least approximately parallel to the first connecting member 4 in the closed condition.

This first sliding guide 16 is assigned to let slide a first slide 17 connected, via a respective third pivot pin 18, to the end 10 of the arm 8 opposite to the connection point of the elastic means 7.

The arm 8 has a slightly curved central section and bears the through slot 2.

The arm 8 and the end 10 form a sort of "τ" (small Greek letter tau) the lower portion of which carries the second pivot pin 9, the upper portion toward the first connecting member 4 bears the third pivot pin 18 and the opposed upper portion is connected to the elastic means 7.

The arm 8 has a projection 23 assigned to abut with a stop 24 of the second member 5, in the full open condition A to provide a solid abutment and support to the first member 4.

The function of the device provides that the friction amount between the first and second members, or between the appliance and its door, changes depending on the width of the slot which has been determined in-the production phase to obtain a specific braking profile.

For example, considering initially the closed condition wherein the angle between the first 4 and the second 5 connecting members is zero, up to about 2° the device has a minimal friction as the rod freely slides in the corresponding section of the slot. From about 5° to about 55° or 60° the opening and/or closing movement of the hinge appears to have more friction followed due to the progressive narrowing of the slot, which interferes with the diameter of the elastic rod of the friction means 3.

From about 55° or 60° to about 85° the slot begins to widen, thus reducing the interference with the diameter of the rod and the friction, thus reducing the friction that opposes the movement of opening and closing of the hinge device.

At about 87°, or just before, a pair of protrusions realize the narrowing of the slot described above and at about 88° the width of the cam still increases leaving free the rod which, however, having difficulty to overcome the narrowing, guarantees the stability of the device in the full open condition.

An advantage of the present invention is to provide a device which offers a braking effect as a function of the opening angle according to a law determined in any stage of production according to the contingent needs.

Another advantage is to provide a device capable of providing an almost constant additional braking effect.

Further advantage is to provide a reliable, long lasting and relatively simple and inexpensive device.

The invention claimed is:

1. A balanced hinge device having a programmable brake for appliances or furniture comprising:

a first connecting member and a second connecting member mutually pivoted through a first pivot pin and interconnected by a kinematic device having at least one arm hinged by a second pivot pin to one of the first and second connecting members;

said first connecting member and said second connecting member being respectively adapted to be fixed to a door and to a structure or frame of the appliance or furniture, for rotation of the door between a full closed condition and a full open condition;

the arm or at least one of the two connecting members having a through slot, and the arm or the other connecting member having a friction element slidably engaged by friction in the through slot, the through slot being approximately shaped according to a trajectory followed by the friction element as the friction element travels between the full closed condition and the full open condition, as viewed from the arm or connecting member that bears the through slot;

wherein the kinematic device has elastic means having an end fixed in position and another end connected to an end of the arm opposite to the second pivot pin to provide a balancing elastic force to the first connecting member and the second connecting member, directed towards the full closing condition;

wherein the through slot is located in the arm and the friction element is fixed to the second connecting member;

the friction element including a deformable rod engaged within the through slot and being slidable therein and having one end fixed to the second connecting member and another end having an enlarged head adapted to prevent the rod from disengaging from the through slot, the rod being made at least partially of an elastic material;

a width or a transverse dimension of the through slot being varied from a value approximately equal to or slightly greater than a transverse dimension of the rod in an undeformed condition to a value smaller than a transverse dimension of the rod in the undeformed condition; and, wherein the through slot transverse dimension is modulated to predetermine and program a friction and braking action between the through slot and the friction element at predetermined opening angles of the first and second connecting members.

2. The hinge device according to claim 1 wherein the rod end opposite to the end bearing the enlarged head has interlocking means for fixing the rod to a bushing fixed in a seat located in the second connecting member.

3. The hinge device according to claim 1 wherein inner edges of the through slot have an increased friction and the rod engaged therewith has a soap bar shape.

4. The hinge device according to claim 1 wherein inner edges of the through slot have an increased friction and the rod engaged therewith has a cylindrical shape.

5. The hinge device according to claim 2, wherein mutually facing surfaces of the enlarged head and the bushing are flat, and a portion of the rod has a length approximately equal to or slightly smaller than a thickness of the arm, such that the flat surfaces abut with and frictionally engage opposite faces of the arm for exerting a braking action.

6. The hinge device according to claim 1 wherein the second connecting member has a first sliding guide, which is located at least approximately parallel to the first connecting member when in the closed condition, and further comprising a first slide connected via a third pivot pin to an end of the arm, the third pivot pin being fixed to the end of the arm in a position approximately opposite to a connection point of the elastic means (7).

7. The hinge device according to claim 6 wherein the arm has a slightly curved central portion bearing the through slot, and wherein the arm and the end of the arm form a substantially T shape having a lower portion which carries the second pivot pin.

8. The hinge device according to claim 7 wherein an upper portion of the substantial T shape facing the first connecting member bears the third pivot pin and an opposed upper portion is connected to the elastic means.

9. The hinge device according to claim 1 wherein the arm has a protrusion adapted to abut a stop of the second connecting member, when in the full open condition.

* * * * *